US005394859A

United States Patent [19]

Janeway

[11] Patent Number: 5,394,859

[45] Date of Patent: Mar. 7, 1995

[54] BOW SIGHT MOUNT

[76] Inventor: Kenneth D. Janeway, 7030 S. 151 W. Ave., Sapulpa, Okla. 74066

[21] Appl. No.: 111,655

[22] Filed: Aug. 25, 1993

[51] Int. Cl.[6] ..... F41G 1/467

[52] U.S. Cl. ..... 124/87; 33/265; 411/386

[58] Field of Search ..... 124/87; 33/265; 411/366, 386, 426

[56] References Cited

U.S. PATENT DOCUMENTS

| | | | |
|---|---|---|---|
| 1,909,476 | 5/1933 | Trotter | 411/386 |
| 4,584,777 | 4/1986 | Saunders | 33/265 |
| 4,600,343 | 7/1986 | Frerejacques | 411/386 X |
| 4,788,961 | 12/1988 | Toth | 124/87 X |
| 5,048,193 | 9/1991 | Hacquet | 33/265 |
| 5,050,576 | 9/1991 | Larson | 124/87 |
| 5,072,716 | 12/1991 | Sappington | 124/87 |
| 5,131,153 | 7/1992 | Seales | 33/265 |
| 5,228,204 | 7/1993 | Khoshnood | 33/265 |

*Primary Examiner*—Randolph A. Reese
*Assistant Examiner*—John A. Ricci
*Attorney, Agent, or Firm*—Frank J. Catalano; Scott R. Zingerman

[57] ABSTRACT

A bow sight mount includes a mounting plate, a sliding bar and a lock. The bar is adapted at one of its ends to be fixed to the bow sight and the plate is adapted to be permanently fastened to the lock. At least one threaded aperture extends transversely through the bar. The plate, which has a channel extending through its length contoured to snugly, reciprocally, slidably receive the bar, has a smooth locking aperture of diameter less than the threaded aperture in the bar and positioned so as to be alignable with the threaded aperture as the bar slides in the channel. A frusto-conical sink extends into and is aligned with the locking aperture. The lock includes a knob with a threaded shaft rotationally engagable in the threaded aperture. The end of the shaft has a frusto-conical taper to complement the frusto-conical sink in the plate and a cylindrical tip snugly insertable into the locking aperture. Thus, when the threaded aperture and the locking aperture are in approximate alignment, rotation of the knob causes the shaft to penetrate into the bar until the cylindrical tip of the shaft penetrates into and bears against the sink in the bar. As the tip bears against the sink, the bar shifts to substantially align the threaded aperture with the locking aperture permitting the cylindrical tip to be snugly inserted into the locking aperture and precisely securing the bar and the plate together.

7 Claims, 3 Drawing Sheets

BOW SIGHT MOUNT

BACKGROUND OF THE INVENTION

This invention relates generally to archery equipment and more particularly concerns bow sights.

A variety of mounts for securing a bow sight to a bow are presently available. One segment of the mount is permanently secured to the bow and one segment to the sight. The archer connects the segments and zeros in a plurality of pin settings on the sight, one for each of the distances at which the archer expects to shoot. Once the pin settings are set, the archer can disconnect the sight segment from the mount segment and put it in a protective case for transportation so as to assure that the pin settings will not be inadvertently changed. When the bow sight is to be used, the sight segment is removed from the transport case and reconnected to the mount segment. Assuming the pins have not shifted during transport, the accuracy of the bow at the selected bow sight distances should be assured.

However, known bow sight mounts permit variation in positioning the bow sight segment on the mount segment, resulting at worst in inaccuracy of the sight and at best a doubt in the archer's mind as to its accuracy.

Variation occurs in the known mounts because the locking mechanism which secures the bow sight segment in place on the mounting segment does not necessarily exactly reposition the sight in the position it originally held when it was zeroed in. Furthermore, even if known bow sights are by chance locked in their original zeroed-in condition, the increased power of modern bows causes a vibration in the bow which, after one or more shots, can cause the bow sight segment to shift in its mount segment during use.

It is, therefore, an object Of this invention to provide a bow sight mount which more assuredly remounts a bow sight in the same position on a bow as prior to dismount. It is also an object of this invention to provide a bow sight mount which more assuredly locks the bow sight in a fixed position on the bow despite vibration or jostling of the bow during use. Another object of the present invention is to provide a bow sight which enables an archer to quickly mount, dismount and remount a bow sight on a bow with minimal variation in zeroed-in accuracy of the sight.

SUMMARY OF THE INVENTION

In accordance with the invention, a bow sight mount is provided consisting of a mounting plate, a sliding bar and a lock. The sliding bar is adapted at one of its ends to be fixed to the bow sight. At least one threaded aperture extends transversely through the bar. The mounting plate, which will be permanently fixed to the bow, has a channel extending through its length contoured to snugly, reciprocally, slidably receive the bar. A smooth aperture of a diameter less than the diameter of the threaded aperture in the bar extends through the plate and is alignable with the threaded aperture in the bar as the bar slides in the channel. A frusto-conical sink extends into and is aligned with the smooth aperture in the plate. The lock includes a knob with a threaded shaft which can be rotationally engaged in the threaded aperture in the bar by turning of the knob. The shaft has frusto-conical end tapered to complement the frusto-conical sink in the plate. Extending beyond the frusto-conical end in the shaft is a cylindrical tip which is snugly insertable into the smooth aperture in the plate. Thus, when the threaded aperture in the bar and the smooth aperture in the plate are in approximate alignment, rotation of the knob causes the shaft to penetrate into the bar until the cylindrical tip of the shaft penetrates into and bears against the sink in the bar. As the tip bears against the sink, the bar slides in the channel to substantially align the threaded aperture in the bar with the smooth aperture in the plate and thus permit the cylindrical tip to be snugly inserted into the smooth aperture. The snug engagement of the cylindrical tip in the smooth aperture of the plate secures the bar and the plate with the apertures in the substantially aligned condition. This positioning assures that the same alignment will be obtained regardless of the number of times the bow sight is mounted or dismounted from the bow and regardless of any amount of vibration or jostling that might be experienced once the bow sight is mounted on the bow.

In a preferred embodiment of the mount, a plurality of threaded apertures will be provided through the bar so that the archer may select from two or more mounting positions the mounting position that is most comfortable for the archer. Preferably, the bar and channel are of trapezoidal cross-section, though any cross-section preventing rotation of the bar within the channel is acceptable.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
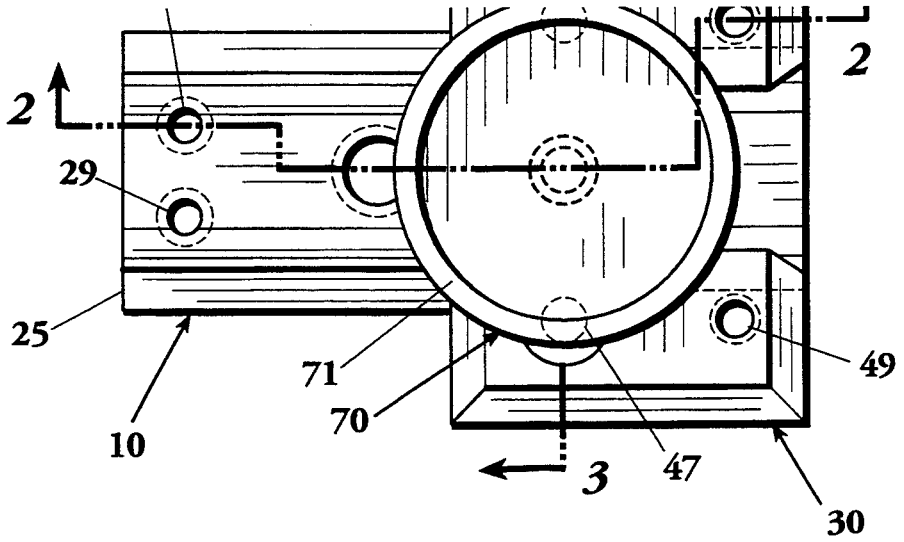
FIG. 1 is a front elevation view of a preferred embodiment of the bow sight mount of the present invention.
Figure 2:
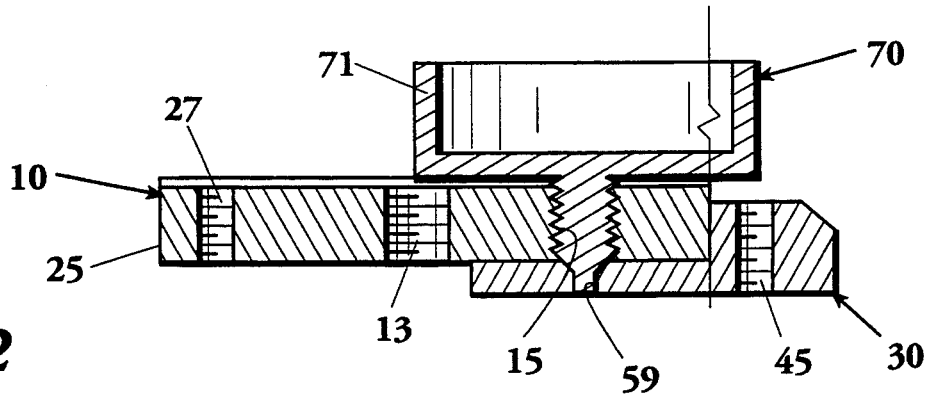
FIG. 2 is a sectional view taken along the line 2—2 of FIG. 1.
Figure 3:
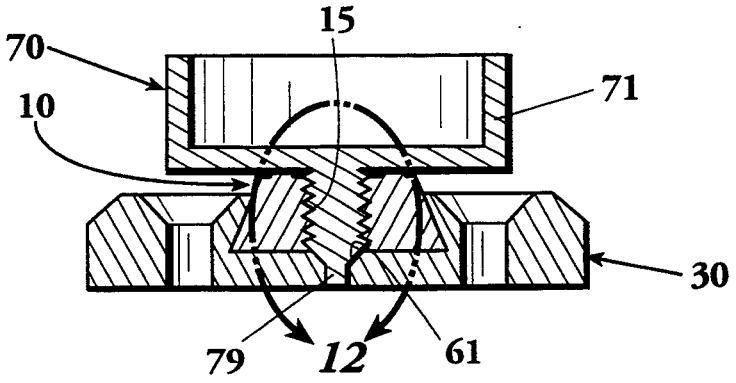
FIG. 3 is a sectional view taken along the line 3—3 of FIG. 1.

Turning first to FIGS. 1, 2 and 3, a preferred embodiment of the bow sight mount is illustrated in the assembled condition. The mount consists of a bar 10 which slides in a mounting plate 30 and is secured in a selectable position relative to the plate 30 by a lock 70.

Figure 4:
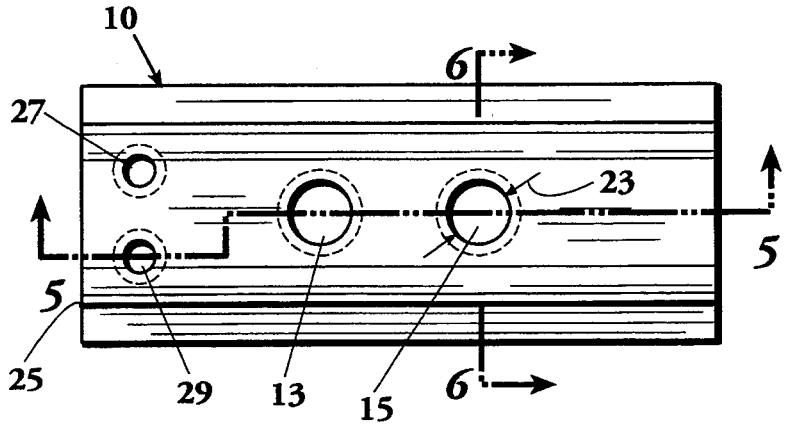
FIG. 4 is a front elevation view of the sliding bar of the mount of FIG. 1.
Figure 5:
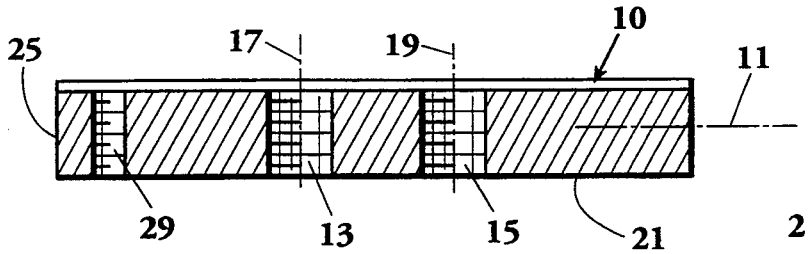
FIG. 5 is a sectional view taken along the line 5—5 of FIG. 4.
Figure 6:
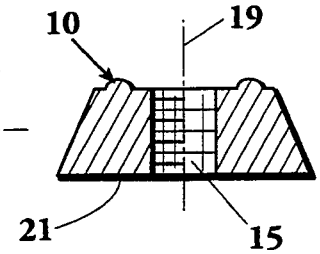
FIG. 6 is a sectional view taken along the line 6—6 of FIG. 4.

The preferred embodiment of the sliding bar 10 is illustrated in FIGS. 4, 5 and 6. As can best be seen in FIG. 6, the bar 10 is substantially trapezoidal in a cross-section taken transversely with respect to the longitudinal axis 11 of the bar 10. Two threaded apertures 13 and 15 extend through the bar 10 aligned on spaced apart axes 17 and 19, respectively, the axes 13 and 19 being transverse to the longitudinal axis 11 of the bar 10 and perpendicular to the base 21 of the trapezoidal cross-section. Any number of internally spaced threaded apertures may be used. Preferably, as shown, the diameter of the apertures 13 and 15 is relatively large and centered on the trapezoidal cross-section. The bar 10 is also provided proximate one of its ends 25 with a pair of threaded apertures 27 and 29 through which screws (not shown) may be inserted to fix the bow sight (not shown) to the sliding bar 10. Of course, depending on the structure of the bow sight to be used, other adapted structural modifications can be made to the bar 10 to facilitate coupling with the bow sight.

Figure 7:
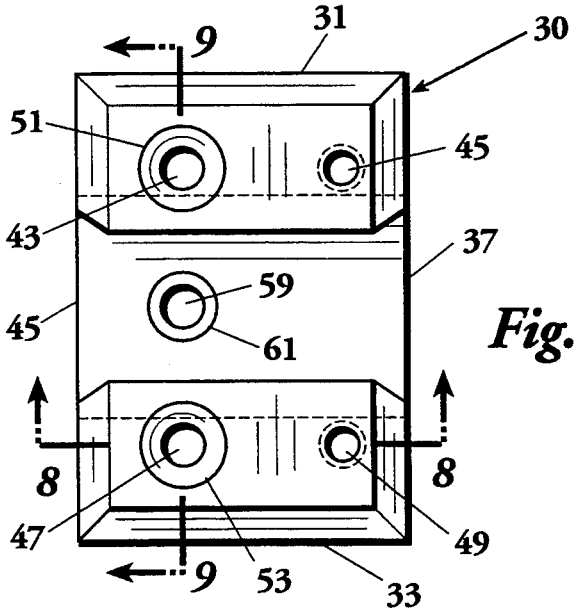
FIG. 7 is a front elevation view of the mounting plate of the mount of FIG. 1.
Figure 8:
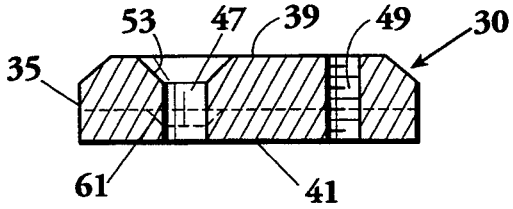
FIG. 8 is a sectional view taken along the line 8—8 of FIG. 7.
Figure 9:
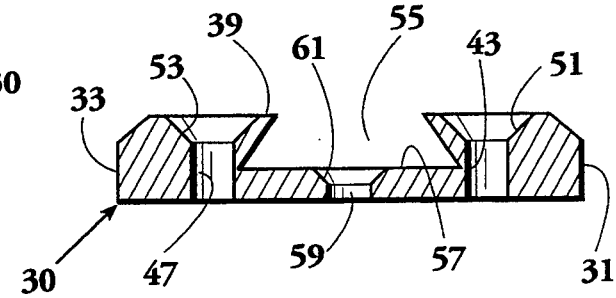
FIG. 9 is a sectional view taken along the line 9—9 of FIG. 7.

The mounting plate 30 is illustrated in FIGS. 7, 8 and 9. Taken in relation to its mounted position on a bow (not shown) held by an archer, the mounting plate 30 has a top edge 31, a bottom edge 33 and opposed side edges 35 and 37. Preferably, the front face 39 will be chamfered along the edges 31, 33, 35 and 37 to eliminate sharp corners on the exposed face 39. The back face 41 will be fixed to the surface of the bow (not shown). To facilitate fixing the plate 30 to the bow (not shown), apertures 43 and 45 extend transversely through the plate 30 proximate its top edge 41 and apertures 47 and 49 extend transversely through the plate 30 proximate its bottom edge 33. As shown, two of the apertures 43 and 47 are smooth surfaced and provided with sinks 51 and 53 while the other apertures 45 and 49 are threaded. While the arrangement shown is preferred, any adaptive structure may be used which will facilitate attachment of the plate 30 to the bow (not shown). Extending longitudinally across the plate 30 is a channel 55 which is contoured to snugly, slidably receive the bar 10 therein. Thus, in the preferred embodiment in which the bar 10 is of trapezoidal cross-section, the channel 55 is also trapezoidal and preferably has a base 57 parallel to the back face 41 of the plate 30. A smooth locking aperture 59 extends from the base 57 of the channel 55 through the back face 41 of the plate 30, preferably centered on the channel 55. A frusto-conical sink 61 is aligned with and extends into the locking aperture 59. The diameter 63 of the locking aperture 59 is substantially less than the diameter 23 of the threaded apertures 27 and 29 through the bar 10. The location of the locking aperture 59 in the plate 30 is such that, as the bar 10 slides within the channel 55 in the plate 30, the threaded apertures 14 and 15 in the bar 10 will align with the locking aperture 59.

Figure 10:
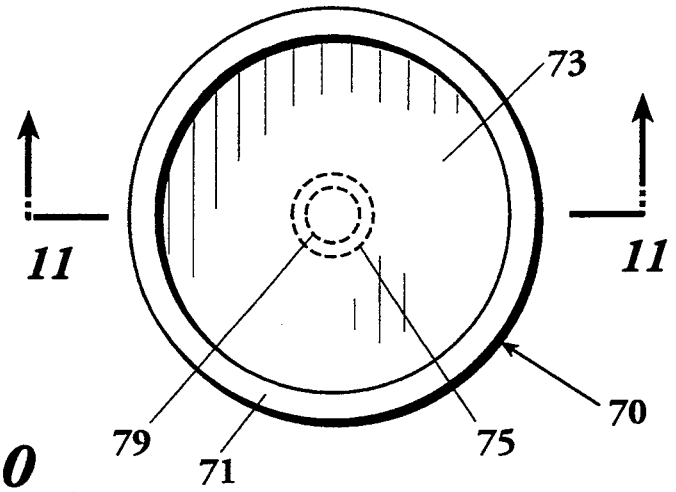
FIG. 10 is a side elevation view of the lock of the bow sight mount of FIG. 1.
Figure 11:
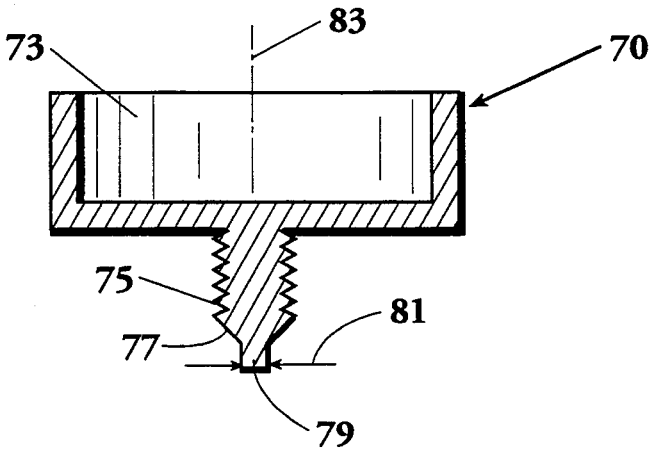
FIG. 11 is a sectional view, taken along line 11—11 of FIG. 10.
Figure 12:
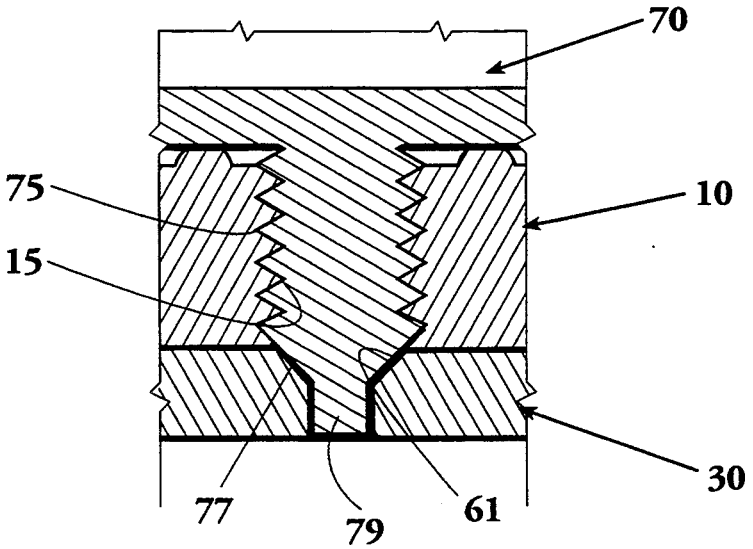
FIG. 12 is an enlarged fragmentary view of the segment of 12—12 of FIG. 3.

The lock 70 is illustrated in FIGS. 10 and 11 and consists of a knob 71, preferably circular and having a hollowed out portion 73 to minimize its weight. A threaded shaft 75 extends from the knob 71. The threads of the shaft 75 complement the threads of the apertures 13 and 15 in the bar 10 so that the lock 70 can be rotationally engaged in the bar 10. The end of the shaft 75 is provided with a frusto-conical taper 77 which complements the frusto-conical slope of the sink 61 in the locking aperture 59. A cylindrical tip 79 at the narrow end of the frusto-conical taper 77 has a diameter 81 such that the tip 79 may be snugly inserted into the locking aperture 59 in the plate 30. The shaft 75, the frusto-conical taper 77 and the cylindrical tip 79 are all aligned on the same longitudinal axis 83 of the lock 70. The length of the threaded portion of the shaft 75 is such that, when the threaded shaft 75 is fully rotationally inserted into one of the threaded apertures 13 or 15 in the bar 10, the frusto-conical taper 77 and the cylindrical tip 79 extend beyond the base 21 of the bar 10.

Returning back to FIGS. 1, 2, 3 and 12, the operation of the bow sight mount can be understood. The plate 30 is fastened to the bow (not shown), for example by use of screws or pins (not shown) through the apertures 43, 45, 47 and 49 provided in the plate 30. The bow sight (not shown) is fastened to the sliding bar 10 proximate one of its ends 25, for example, by use of screws (not shown) through the apertures 25 and 27 provided in the bar 10. The bar 10 is slidably inserted into the plate 30 until a selected threaded aperture 13 or 15 in the bar 10 is approximately aligned with the locking aperture 59 in the plate 30. With this approximate alignment accomplished, the lock 70 is threaded into the selected aperture 13 or 15 in the bar 10 and, if the alignment of the threaded aperture 13 or 15 and the locking aperture 59 is not perfect, the cylindrical tip 79 will engage with the frusto-conical sink 51 and cause the bar 10 to slide in the channel 55. The bar 10 will slide until the cylindrical tip 79 comes into alignment with the locking aperture 59 and is snugly inserted therein. Thus, the lock 70 accurately aligns the aperture 13 or 15 through the bar 10 with the locking aperture 59 through the plate 30. Once so secured, the snug arrangement of the cylindrical tip 79 in the locking aperture 59 prevents further sliding of the bar 10 in the channel 55 regardless of any vibration in the bow or jostling of the device that may occur. Once the bow sight has been zeroed in, the knob 71 can be rotated to withdraw the cylindrical tip 79 from the locking aperture 59 and the bar 10 removed from the channel 55 so that the zeroed in bow sight can be cased for safe transport. When the bow sight mount is reassembled, the archer can be assured that the bar 10 will again be accurately aligned in the same position in the plate 30 that it was when the sight was zeroed in.

It should be noted that any number of configurations are possible for the bar 10, the plate 30 and the lock 70 provided that the proper alignment of the threaded apertures 13 and 15 in the bar 10 and the locking aperture 59 in plate 30 can be accomplished and that the tip 79 of the lock 70 will be guided into snug engagement with the locking aperture 59 in the plate 30 so as to assure accurate positioning of the bar 10 in relation to the plate 30.

Thus, it is apparent that there has been provided, in accordance with the invention, a bow sight mount that fully satisfies the objects, aims and advantages set forth above. While the invention has been described in conjunction with a specific embodiment thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A mount for a bow sight comprising:

a bar having one end thereof adapted to be fixed to said bow sight and a threaded aperture extending transversely therethrough;

a plate having a channel extending through a length thereof, said channel having a cross-section contoured to snugly, reciprocally, slidably receive said bar therein, said plate having a smooth aperture therethrough of diameter less than said threaded aperture and alignable with said threaded aperture as said bar slides in said channel and a frusto-conical sink extending into and aligned with said smooth aperture; and a lock having a knob and a threaded shaft extending from said knob along a longitudinal axis of said shaft for rotational engagement in said threaded aperture, said shaft having a frusto-conical end tapered to compliment said sink and a cylindrical tip snugly insertable into said smooth aperture in said plate whereby, when said threaded and smooth apertures are in approximate alignment and said lock is rotated to penetrate said bar, said tip penetrates into and bears against said sink, causing said bar to shift to substantially align said apertures and permitting said tip to be inserted into said smooth aperture, securing said bar and said plate with said apertures in said substantially aligned condition.

2. A mount according to claim 1, said bar having a trapezoidal cross-section transverse to a longitudinal axis of said bar.

3. A mount according to Claim 2, said threaded aperture extending along an axis perpendicular to a base of said trapezoidal cross-section.

4. A mount according to claim 3, said plate having parallel opposing faces and said channel having a trapezoidal cross-section having a base in a plane parallel to and between said faces.

5. A mount according to claim 1 further comprising at least one additional threaded aperture substantially identical to said threaded aperture, each said additional aperture extending transversely through said bar and intervally spaced from said threaded aperture along a longitudinal axis of said bar whereby said smooth aperture may be aligned with a selected one of said additional apertures and said threaded aperture as said bar slides in said channel.

6. A mount according to claim 1 further comprising at least one additional smooth aperture and frusto-conical sink substantially identical to and intervally spaced from said smooth aperture and frusto-conical sink and extending through said plate and alignable with said threaded aperture as said bar slides in said channel.

7. A mount for a bow sight comprising:

a bar of trapezoidal dross-section transverse to a longitudinal axis thereof having one end thereof adapted to be fixed to said bow sight and a threaded aperture of relatively large diameter extending therethrough along an axis perpendicular to a base of said trapezoidal cross-section;

a plate having a top edge, a bottom edge, opposed side edges, opposed faces and a channel extending across one of said faces and between said side edges, said channel having a cross-section contoured to snugly, reciprocally, slidably receive said bar therein, said plate having a smooth aperture therethrough of diameter less than said threaded aperture on an axis alignable with said threaded aperture axis as said bar slides in said channel and a frusto-conical sink extending from a base of said channel into and axially aligned with said smooth aperture; and a lock having a knob and a threaded shaft extending from said knob along a longitudinal axis of said shaft for rotational engagement in said threaded aperture, said shaft having a frusto-conical end tapered to compliment said sink and a cylindrical tip snugly insertable into said smooth aperture in said plate whereby, when said threaded and smooth apertures are in approximate alignment and said lock is rotated to penetrate said bar, said tip penetrates into and bears against said sink, causing said bar to shift to substantially align said apertures and permitting said tip to be inserted into said smooth aperture, securing said bar and said plate with said apertures in said substantially aligned condition.

* * * * *